US008379876B2

(12) United States Patent
Zhang

(10) Patent No.: US 8,379,876 B2
(45) Date of Patent: Feb. 19, 2013

(54) AUDIO DEVICE UTILIZING A DEFECT DETECTION METHOD ON A MICROPHONE ARRAY

(75) Inventor: Ming Zhang, Cupertino, CA (US)

(73) Assignee: Fortemedia, Inc, Sunnyvale, CA (US)

( * ) Notice: Subject to any disclaimer, the term of this patent is extended or adjusted under 35 U.S.C. 154(b) by 1126 days.

(21) Appl. No.: 12/127,087

(22) Filed: May 27, 2008

(65) Prior Publication Data

US 2009/0296946 A1 Dec. 3, 2009

(51) Int. Cl.
*H04R 3/00* (2006.01)
*H04R 29/00* (2006.01)

(52) U.S. Cl. ..... 381/92; 381/58

(58) Field of Classification Search ..... 381/58, 381/92

See application file for complete search history.

(56) References Cited

U.S. PATENT DOCUMENTS

RE33,332 E * 9/1990 Furuya et al. ..... 714/755

* cited by examiner

*Primary Examiner* — Howard Weiss
(74) *Attorney, Agent, or Firm* — McClure, Qualey & Rodack, LLP

(57) ABSTRACT

An audio device is provided, employing a defect detection method to detect defectiveness within a microphone array. The microphone array comprising a first microphone and a second microphone, respectively, generates a first audio signal and a second audio signal from ambient audio signals. An error detector is provided to detect functions of the first and second microphones based on the first and second audio signals to generate a status signal. A digital signal processor (DSP) processes the first and second audio signals based on the status signal. If the status signal indicates that only the first microphone or the second microphone is defective, the DSP switches to a single microphone mode in which only the remaining normal microphone is enabled. If the status signal indicates that both the first and second microphones are defective, the DSP generates an error indication signal and stops processing the first and second audio signals.

13 Claims, 8 Drawing Sheets

AUDIO DEVICE UTILIZING A DEFECT DETECTION METHOD ON A MICROPHONE ARRAY

BACKGROUND OF THE INVENTION

1. Field of the Invention

The invention relates to microphone arrays, and in particular, to defect detection of a microphone array utilized in an audio device.

2. Description of the Related Art

Microphone arrays are widely used in audio processing apparatuses for distinguishing desired audio signals from ambient noises. During ordinary usage, however, one or more microphones within a microphone array may be defective. As known, audio signals received by a microphone array are sent to a digital signal processor (DSP) for processing, such as a beam forming process or noise reduction process. If one microphone within the microphone array is defective, the beam forming process may render unpredictable results, whereby the audio quality would be degraded. Conventionally, there is no efficient method to detect that a microphone in a microphone array may be defective. As a result, as the number of microphones in a microphone array increases, the possibility for one of the microphones to be defective also increases. Also, undetected defective microphones, with even minor defects, may negatively degrade microphone arrays due in part to undetermined microphone functions. For such a reason, it is desirable to implement a defect detection mechanism in a microphone array to adaptively adjust the microphone array based on the functions of microphones therein.

BRIEF SUMMARY OF THE INVENTION

An exemplary embodiment of an audio device is provided, employing a defect detection method to detect defectiveness within a microphone array. The microphone array comprising a first microphone and a second microphone, respectively, generates a first audio signal and a second audio signal from ambient audio signals. An error detector is provided to detect functions of the first and second microphones based on the first and second audio signals to generate a status signal. A digital signal processor (DSP) processes the first and second audio signals based on the status signal. If the status signal indicates that only the first microphone or the second microphone is defective, the DSP switches to a single microphone mode in which only the remaining normal microphone is enabled. If the status signal indicates that both the first and second microphones are defective, the DSP generates an error indication signal and stops processing the first and second audio signals.

In the error detector, a first activity detector compares the first audio signal with a local activity threshold to generate a first activity flag for indicating voice activity of the first audio signal. A second activity detector compares the second audio signal with the local activity threshold to generate a second activity flag for indicating voice activity of the second audio signal. A power difference detector compares the first and second audio signals to generate a power difference flag for indicating whether the differences between the first and second audio signals exceed a predetermined ratio. A correlation detector determines correlation of the first and second audio signals to generate a correlation flag for indicating whether the first and second audio signals are correlated.

The error detector further comprises a statistic unit, observing the first activity flag, second activity flag, power difference flag and correlation flag over a predetermined time period to generate corresponding statistical results. A decision unit then generates the status signal based on the statistical results.

If the first audio signal exceeds the local activity threshold, the first activity detector sets the first activity flag to a positive value, otherwise to a zero value. The statistic unit averages a plurality of first activity flags observed within a time period, and if an average of the first activity flags exceeds a first threshold, the statistic unit generates a first error flag of a positive value, otherwise of a zero value. The statistic unit averages a plurality of first error flags observed within the predetermined time period, and if an average of the first error flags exceeds a first failure threshold, the statistic unit generates a first failure flag of a positive value, otherwise of a zero value.

If the second audio signal exceeds the far end activity threshold, the second activity detector sets the second activity flag to a positive value, otherwise to a zero value. The statistic unit averages a plurality of second activity flags observed within a time period, and if an average of the second activity flags exceeds a second threshold, the statistic unit generates a second error flag of a positive value, otherwise of a zero value. The statistic unit averages a plurality of second error flags observed within the predetermined time period, and if an average of the second error flags exceeds a second failure threshold, the statistic unit generates a second failure flag of a positive value, otherwise of a zero value.

If the first audio signal exceeds the second audio signal multiplied by the predetermined ratio, or the second audio signal exceeds the first audio signal multiplied by the determined ratio, the power difference detector sets the power difference flag to a zero value, otherwise a positive value. The statistic unit averages a plurality of power difference flags observed within the predetermined time period, and if an average of the power difference flags exceeds a difference threshold, the statistic unit generates a third error flag of a positive value, otherwise of a zero value.

If correlation between the first and second audio signals exceeds a correlation threshold, the correlation detector sets the correlation flag to a positive value, otherwise to a zero value. The statistic unit averages a plurality of correlation flags observed within the predetermined time period, and if an average of the correlation flags exceeds a correlation criterion, the statistic unit generates a fourth error flag of a positive value, otherwise of a zero value.

The error detector is enabled only when the first and second microphones are not muted, and is disabled when the first and second microphones are muted. If the first error flag, second error flag, third error flag and fourth error flag are positive, the decision unit sets the status signal to a first value, to indicate that both the first and second microphones are good. If the first error flag, third error flag and fourth error flag are zero while the second error flag is positive, the decision unit sets the status signal to a second value, to indicate that the first microphone is defective. If the second error flag, third error flag and fourth error flag are zero while the first error flag is positive, the decision unit sets the status signal to a third value, to indicate that the second microphone is defective.

The audio device may receive a line in signal while in a communication mode. The error detector further comprises a far end activity detector, comparing the line in signal with a far end activity threshold to generate a far end activity flag for indicating voice activity of the line in signal. If the line in signal exceeds the far end activity threshold, the far end activity detector sets the far end activity flag to a positive value, otherwise to a zero value. The statistic unit averages a plurality of far end activity flags observed within the predetermined time period, and if an average of the far end activity flag exceeds a far end activity criterion, the statistic unit generates a fifth error flag of a positive value, otherwise of a zero value.

If the audio device is in the communication mode, and the first error flag, second error flag, first failure flag, second failure flag and fifth error flag are all zero, the decision unit sets the status signal to a fourth value, to indicate that both the first and second microphones are defective.

The audio device may further comprise a first ADC and a second ADC, digitizing the first and second audio signals before the error detector and the DSP processes the second audio signal. A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
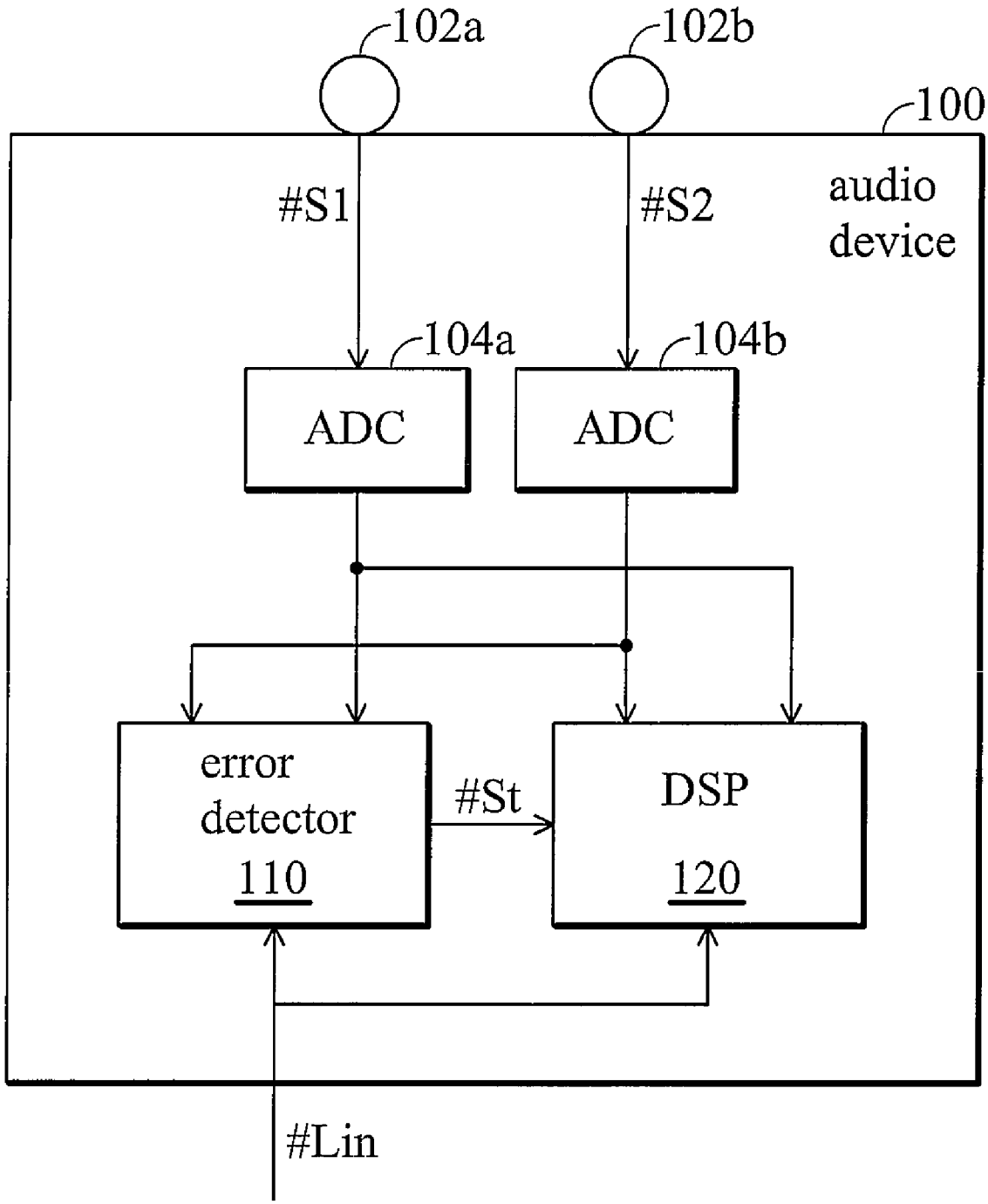
FIG. 1 shows an embodiment of an audio device 100 comprising an error detector 110 according to the invention.

FIG. 1 shows an embodiment of an audio device 100 comprising an error detector 110 according to the invention. In the audio device 100, a microphone array is formed by a first microphone 102*a* and a second microphone 102*b* for receiving ambient audio signals. A first audio signal #S1 and a second audio signal #S2 respectively observed by the first microphone 102*a* and the second microphone 102*b* are digitized by a first analog to digital converter (ADC) 104*a* and a second ADC 104*b* and then processed in the DSP 120. The error detector 110 is an additional function block added by the invention, dedicated to detect functions of the first microphone 102*a* and the second microphone 102*b* based on the first audio signal #S1 and second audio signal #S2. A status signal #St is generated by the error detector 110 to indicate whether the first microphone 102*a* and second microphone 102*b* are normal or defective, such that the DSP 120 can accordingly processes the first audio signal #S1 and second audio signal #S2. For example, if the status signal #St indicates that only the first microphone 102*a* or the second microphone 102*b* is defective, the DSP 120 switches to a single microphone mode, whereby only the audio signal sent from the remaining normal microphone is processed. Furthermore, if the status signal #St indicates that both the first microphone 102*a* and second microphone 102*b* are defective, no audio function would be processed. Thus, the DSP 120 may generate an error indication signal and stop processing the first audio signal #S1 and second audio signal #S2. In the embodiment, the audio device 100 may be a digital recorder that transforms audio signals into a file. The audio device 100 may also be deployed in a communication device such as a mobile phone, therefore a line in signal #Lin would be inputted to the error detector 110 and DSP 120 while in a communication mode (#comm=1). The line in signal #Lin may represent far end talks, and various situations in the communication mode should be considered when generating the status signal #St. Detailed embodiment of the defect detection is further described below.

Figure 2:
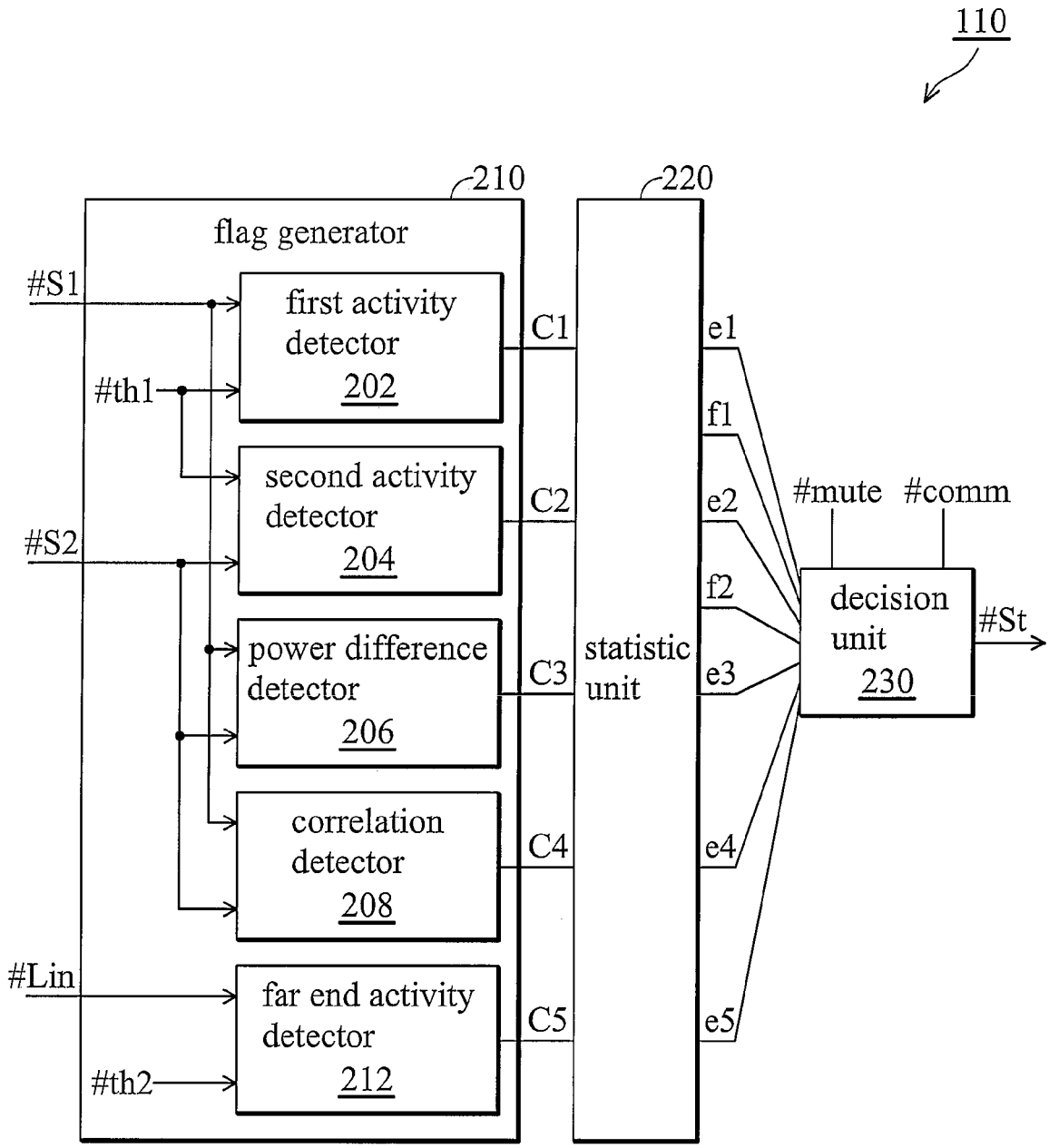
FIG. 2 shows an embodiment of an error detector 110 according to FIG. 1.

FIG. 2 shows an embodiment of an error detector 110 according to FIG. 1. The error detector 110 comprises three processing stages, a flag generator 210, a statistic unit 220 and a decision unit 230. In the flag generator 210, the first audio signal #S1, second audio signal #S2 and line in signal #Lin are input as sequential sample streams, thus various flags are detected accordingly, such as first activity flag c1, second activity flag c2, power difference flag c3, correlation flag c4 and far end activity flag c5. The statistic unit 220 gathers the flags output from the flag generator 210 for observation over a predetermined period of time, thereby various statistical results can be generated as a basis for defect detection. Thereafter, the decision unit 230 receives the statistical results to determine the status signal #St.

In the error detector 110, various flags are detected via different units. A first activity detector 202 compares the first audio signal #S1 with a local activity threshold #th1 to generate a first activity flag c1 that indicates voice activity of the first audio signal #S1. Similarly, a second activity detector 204 compares the second audio signal #S2 with the same local activity threshold #th1 to generate a second activity flag c2 for indicating voice activity of the second audio signal #S2. The local activity threshold #th1 can be properly configured such that the interferences from ambient noises or other circuits can be avoided. Although the first activity detector 202 and second activity detector 204 use an identical local activity threshold #th1 in the embodiment, the first activity detector 202 and second activity detector 204 may also employ different local activity thresholds according to a design of the microphone array, and the invention is not limited thereto. If the first audio signal #S1 exceeds the local activity threshold #th1, the first activity detector 202 sets the first activity flag c1 to a positive value, otherwise to a zero value, and the same principle applies to second activity flag c2. It is to be understood that the positive value can be referred to as logic 1, and the zero value as logic 0.

Furthermore, in the flag generator 210, a power difference detector 206 compares the first audio signal #S1 and the second audio signal #S2 to generate a power difference flag c3 that indicates whether the differences between the first audio signal #S1 and the second audio signal #S2 exceed a predetermined ratio. Normally, the first microphone 102*a* and second microphone 102*b* in a microphone array are expected to acquire audio signals of subsequently identical amplitudes. If any of the microphones are defective, the amplitudes of the first audio signal #S1 and the second audio signal #S2 may exhibit significant differences. Thus, a ratio value $\alpha$ is defined to check the amplitudes. For example, if the first audio signal #S1 exceeds the second audio signal #S2 by $\alpha$ times (#S1>$\alpha$·#S2), or the second audio signal #S2 exceeds the first audio signal #S1 by $\alpha$ times (#S2>$\alpha$·#S1), the power difference detector 206 sets the power difference flag c3 to a zero value (logic 0) to indicate the potential defect.

A correlation detector 208 receives the first audio signal #S1 and the second audio signal #S2 to determine correlation therebetween. Various known correlation algorithms may be used to generate a correlation coefficient ranging from 0 to 1 representing correlativity of the first audio signal #S1 and second audio signal #S2. If the correlation coefficient exceeds a correlation criteria, the correlation detector 208 generates a correlation flag c4 of a positive value, to indicate that the first audio signal #S1 and second audio signal #S2 are correlated. Conversely, if the correlation coefficient does not exceed the correlation criteria, the correlation detector 208 sets the correlation flag c4 to a zero value, to indicate that they are not correlated.

If the audio device 100 is implemented in a communication device, line in signal #Lin sent from a remote end may also be considered when determining defectiveness of the first microphone 102*a* and the second microphone 102*b*. In such a case, a far end activity detector 212 is provided to compare the line in signal #Lin with a far end activity threshold #th2 to generate a far end activity flag c5 for indicating voice activity of the line in signal #Lin. The far end activity threshold #th2 is provided to trim off baseline noises. If the line in signal #Lin exceeds the far end activity threshold #th2, the far end activity detector 212 sets the far end activity flag c5 to a positive value, otherwise to a zero value.

The first activity flag c1, second activity flag c2, power difference flag c3, correlation flag c4 and far end activity flag c5 are then sent to the statistic unit 220 for further diagnosis. The statistic unit 220 individually averages the first activity flag c1, second activity flag c2, power difference flag c3, correlation flag c4 and far end activity flag c5 over a predetermined time period to generate corresponding statistical results. For example, the statistic unit 220 processes a plurality of first activity flags c1 within a time period to generate a first error flag e1 and a first failure flag f1. As described, the audio signals are a consecutive sample stream in which each sample is associated with a particular sample time. A time period is a moving period including a certain number of consecutive samples ranging from a few past sample times to a current sample time. The statistic unit 220 averages all first activity flags c1 observed within the time period, and if the averaged first activity flag exceeds a first threshold, the statistic unit 220 generates a first error flag e1 of a positive value, otherwise of a zero value. The time period is defined as a brief period used during a human conversation period, preferably 1 second to 5 seconds. Thus, the first error flag e1 is used to further confirm an occurrence of voice activity, preventing any short glitches or sudden noises from being counted as ordinary voice activity. The statistic unit 220 further averages all first error flags e1 for a longer period. The long period is a predetermined time period which is long enough for determining the function of the first microphone 102*a*. For example, if an average of the first error flags e1 exceeds a first failure threshold, the statistic unit 220 generates a first failure flag f1 of a positive value, indicating that the voice activity is still operational during the predetermined time period. On the contrary, if the average of first error flags e1 does not exceed the first failure threshold, the first failure flag f1 is set to a zero value, indicating that there is a possibility that the first microphone 102*a* is defective.

The statistic unit 220 processes the second activity flag c2 similarly to generate a second error flag e2 and a second failure flag f2. The second error flag e2 indicates voice activity over a brief period, and the second failure flag f2 indicates whether there is a defect possibility.

In the statistic unit 220, the power difference flag c3 is also averaged over a predetermined time period. If the average of the power difference flags c3 does not promptly exceed a difference threshold, there is a possibility that the phenomenon of microphone sensitivity mismatch has occurred. Thus, the statistic unit 220 generates a third error flag e3 of a zero value.

As to the correlation flag c4, likewise, the statistic unit 220 averages all correlation flags c4 observed within the predetermined time period, and if the average of correlation flags c4 exceeds a correlation criterion, the statistic unit 220 generates a fourth error flag e4 of a positive value, otherwise of a zero value.

When in communication mode, far end talk may interact with a local talker. Normally, when the far end is talking, local voice activity is expected to be decreased. Thus, the line in signal #Lin is also used as a reference for defect detection. The statistic unit 220 averages all far end activity flags c5 within the predetermined time period, and if the average of far end activity flags c5 exceeds a far end activity criterion, the statistic unit 220 generates a fifth error flag e5 of a positive value, otherwise of a zero value.

Generally, an audio device 100 may be able to mute the first microphone 102*a* and the second microphone 102*b* when needed. The error detector 110 can only be enabled when the first microphone 102*a* and the second microphone 102*b* are not muted (#mute=0). If the first microphone 102*a* and second microphone 102*b* are muted (#mute=1), the error detector 110 is consequently disabled, wherein the defect detection process is suspended.

The first error flag e1, second error flag e2, first failure flag f1, second failure flag f2, third error flag e3, fourth error flag e4 and fifth error flag e5 are sent to the decision unit 230, and the decision unit 230 performs defect detection based on the flags to generate the status signal #St. Various conditions are checked. For example, if the first error flag e1, second error flag e2, third error flag e3 and fourth error flag e4 are all positive, it means voice activity on the first microphone 102*a* and second microphone 102*b* are positive, the differences between the first audio signal #S1 and second audio signal #S2 are subsequently matched, and there is high correlation between the first audio signal #S1 and second audio signal #S2. Inherently, both the first microphone 102*a* and second microphone 102*b* are good, so the decision unit 230 sets the status signal #St to a first value. Consequently, the DSP 120 receives the status signal #St and accordingly operates in a normal mode in which both the first audio signal #S1 and second audio signal #S2 are processed. In the normal mode, a noise suppression process is performed to eliminate unwanted noise with various known technologies such as beamforming, blind signal separation or/and others.

If the decision unit 230 finds that the first error flag e1, third error flag e3 and fourth error flag e4 are zero while the second error flag e2 is positive, it means that the voice activity on the first microphone 102*a* cannot be detected while the voice activity on the second microphone 102*b* is detected, the sensitivities of the first microphone 102*a* and second microphone 102*b* are mismatched, and there is a poor correlation between the first audio signal #S1 and second audio signal #S2. Inherently, it can be determined that the first microphone 102*a* is defective. Thus, the decision unit 230 sets the status signal #St to a second value, and consequently, the DSP 120 receives the status signal #St to switch to a single microphone mode whereby only the second audio signal #S2 is processed. Although the performance of a single microphone may not be as good as two or more microphones, it is still rather than using a defective microphone array.

When only the second microphone 102*b* is defective, the case is similar. If the second error flag e2, third error flag e3 and fourth error flag e4 are zero while the first error flag e1 is positive, it can be determined that the first microphone 102*a* is normal but the second microphone 102*b* is defective. Thus, the decision unit 230 sets the status signal #St to a third value, to indicate that the second microphone 102*b* is defective. Therefore, the DSP 120 operates in the single microphone mode according to the status signal #St, in which only the first audio signal #S1 is processed.

If the audio device 100 is in the communication mode (#comm=1), voice activity of far end should also be considered. For example, if the first error flag e1 and the second error flag e2 are zero values while the first failure flag f1 and the second failure flag f2 are also zero, it is highly possibly that both the first microphone 102*a* and second microphone 102*b* are defective. However, it does not necessarily mean both are defective. If the audio device 100 is in the communication mode (#comm=1), and the far end activity is positive, it is intuitive that the local voice activity should be decreased. So when the first error flag e1, second error flag e2, first failure flag f1, second failure flag f2 are all zero, the fifth error flag e5 is checked. If the fifth error flag e5 is a positive value, the situation is assessed as a normal condition. To the contrary, if the fifth error flag e5 is a zero value, it can be determined that both the first microphone 102*a* and second microphone 102*b* are defective, and consequently, the decision unit 230 sets the status signal #St to a fourth value. The operations in the error detector 110 can be summarized into flowcharts as described below.

Figure 3:
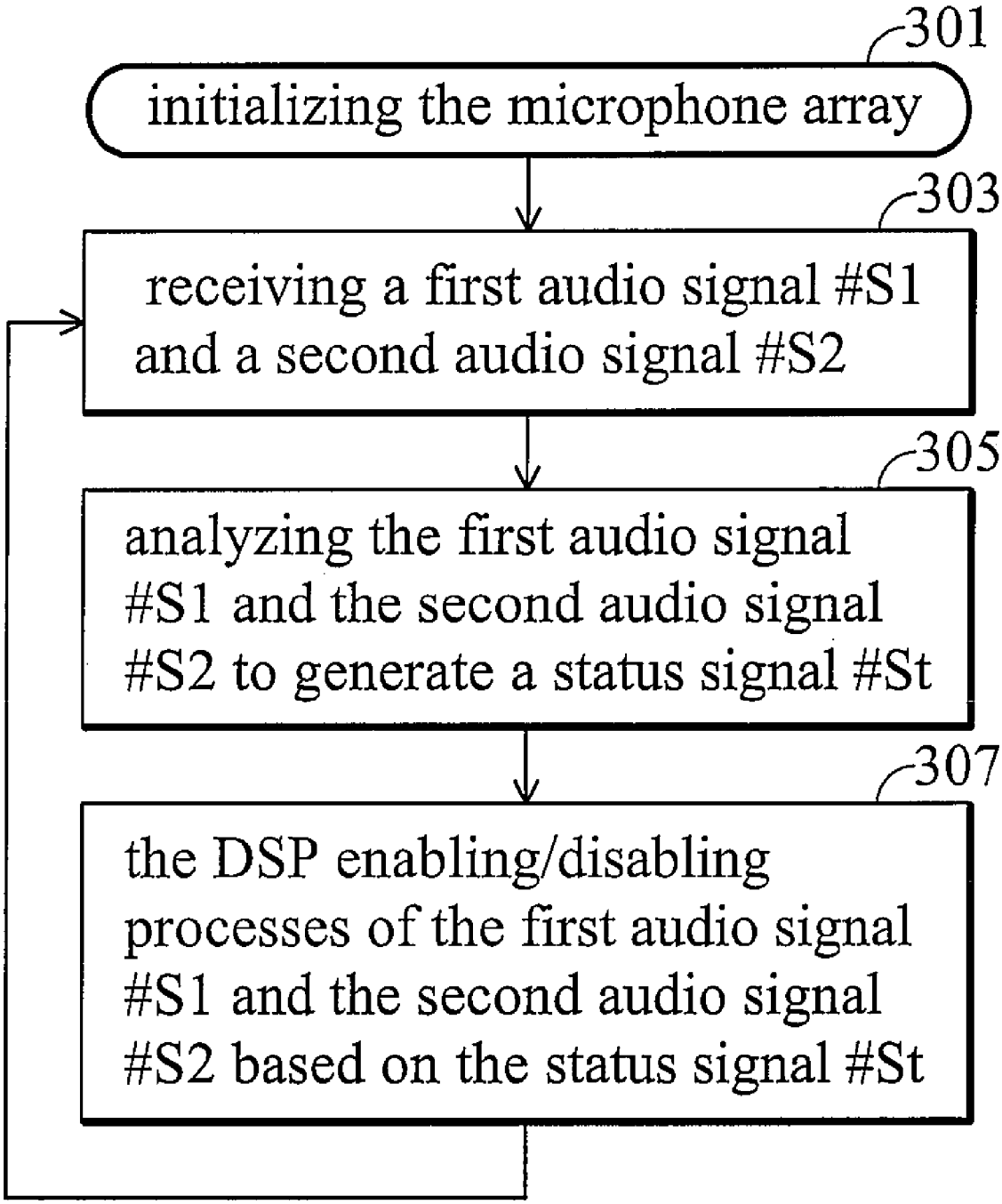
FIG. 3 is a flowchart of microphone array operation according to the invention.

FIG. 3 is a flowchart of microphone array operation according to the invention. In step 301, the microphone array in the audio device 100 is initialized. In step 303, a first audio signal #S1 and a second audio signal #S2 are respectively received by the first microphone 102*a* and the second microphone 102*b*. In step 305, the flag generator 210 functions to determine various flags based on the first audio signal #S1 and second audio signal #S2, and generates a status signal #St to indicate the statuses of the first microphone 102*a* and the second microphone 102*b*. In step 307, the DSP 120 processes the first audio signal #S1 and second audio signal #S2 in various modes based on the status signal #St. For example, if the status signal #St indicates that one microphone is defective, the DSP 120 operates in a signal microphone mode whereby only the remaining normal microphone is used. If the status signal #St indicates that both microphones are defective, the DSP 120 may generate an alarm signal to represent defect of the audio device 100. In the embodiment, the microphone array is implemented by two microphones, a first microphone 102*a* and second microphone 102*b*. However, the invention is not limited thereto. The detection mechanism of the embodiment is applicable to various types of microphone arrays comprising more than two microphones, thus the status signal #St may present various statuses of the microphones and the DSP 120 is able to operate under various conditions such as a single microphone mode, two-microphone mode, three-microphone mode and so on. The operations in FIG. 3 are repeated until the audio device 100 is shut down. When the status signal #St is generated, the process loops to step 303 to process further samples in the first audio signal #S1 and second audio signal #S2.

Figure 4:
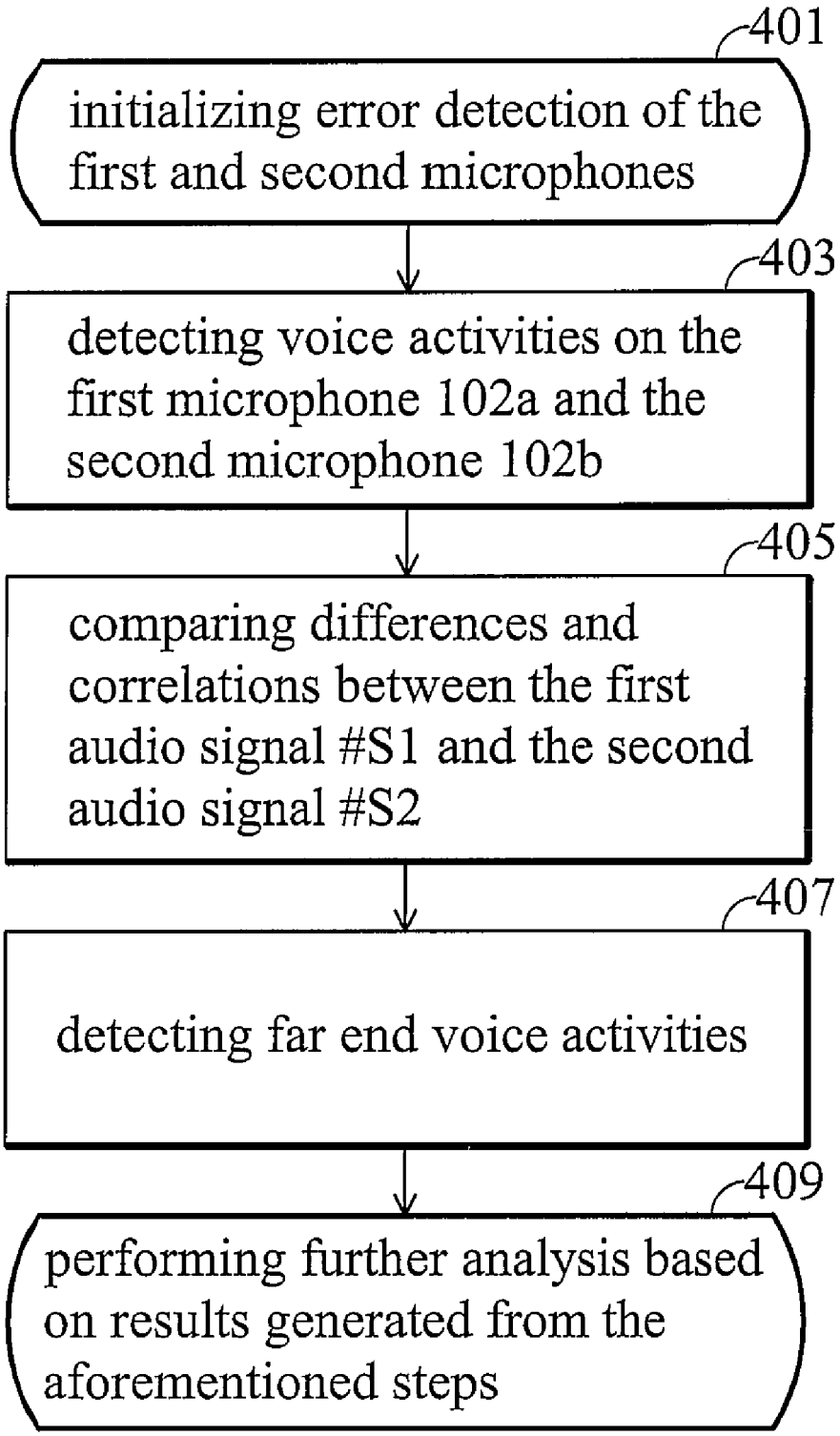
FIG. 4 is a flowchart of defect detection according to the invention.

FIG. 4 is a flowchart of defect detection according to the invention. The step 305 of FIG. 3 is further described herein. In step 401, with the first audio signal #S1 and second audio signal #S2 are provided from the first microphone 102*a* and second microphone 102*b*, defect detection is initialized. In step 403, voice activity on the first microphone 102*a* and second microphone 102*b* are detected. The first activity detector 202 and second activity detector 204 as described in FIG. 2, individually compares the first audio signal #S1 and second audio signal #S2 with a local activity threshold #th1 to generate a first activity flag c1 and a second activity flag c2. Simultaneously, step 405 is processed, in which amplitudes of the first audio signal #S1 and second audio signal #S2 are compared by the power difference detector 206, rendering a power difference flag c3 to indicate whether an abnormal situation is found. Meanwhile, correlation between the first audio signal #S1 and second audio signal #S2 is calculated. The correlation detector 208 of FIG. 2 outputs a correlation flag c4 to indicate whether the first audio signal #S1 and second audio signal #S2 are correlated. In step 407, voice activity of a line in signal #Lin is detected. The far end activity detector 212 compares the line in signal #Lin with a far end activity threshold #th2 to generate a far end activity flag c5 of either a positive value or a zero value. In the embodiment, the first audio signal #S1, second audio signal #S2 and line in signal #Lin are digitized values input to the flag generator 210 as continuous sample streams, and all the flags are generated per sample time. In step 409, all the flags are then sent to the statistic unit 220 for further statistical observations, and detailed embodiments are described below.

Figure 5:
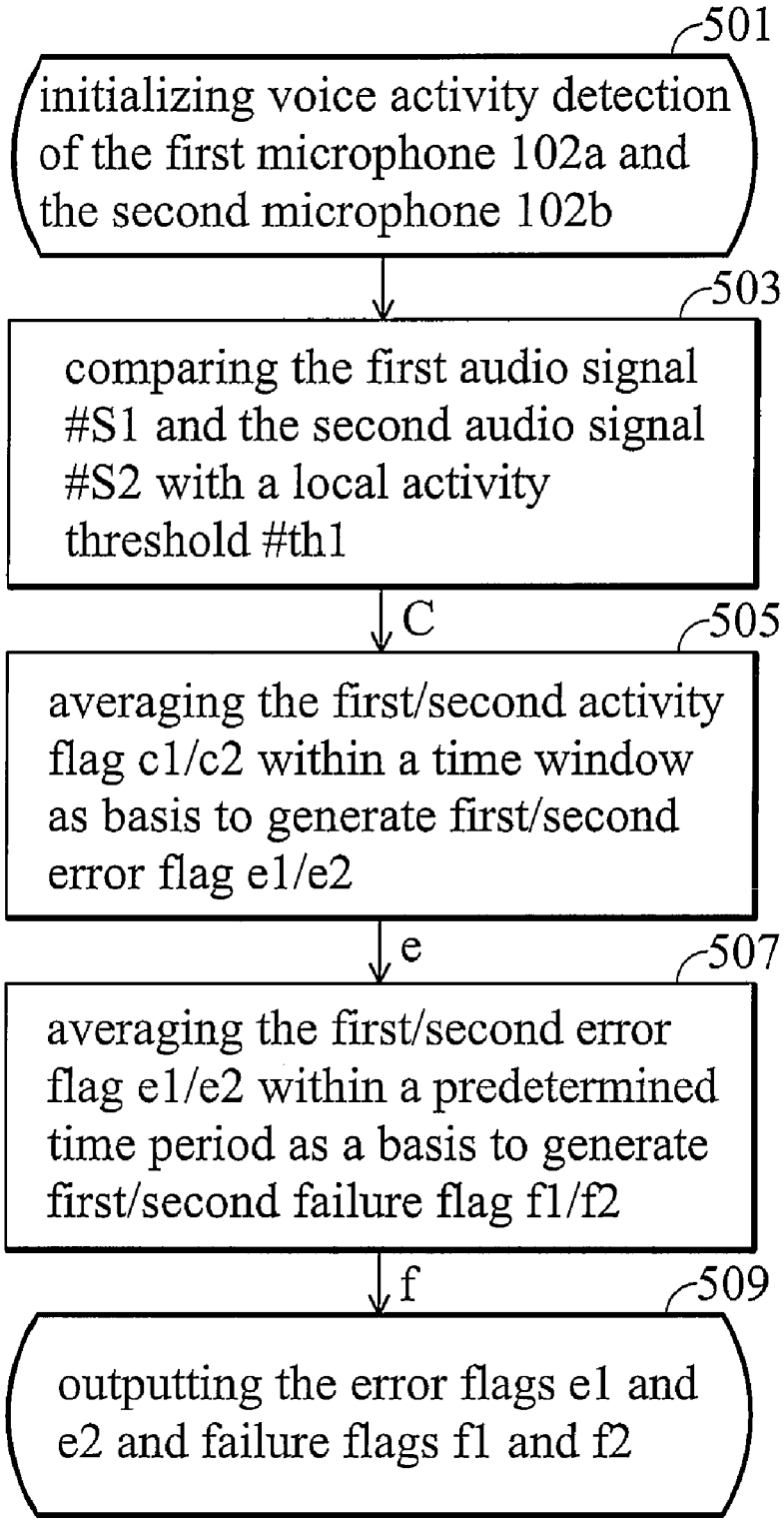
FIG. 5 is a flowchart of voice activity detection for the first microphone 102*a* and the second microphone 102*b;*

FIG. 5 is a flowchart of voice activity detection for the first microphone 102*a* and the second microphone 102*b*. The step 403 in FIG. 4 is initialized in step 501. In step 503, the first audio signal #S1 and second audio signal #S2 are individually compared with a local activity threshold #th1. If the first audio signal #S1 exceeds the local activity threshold #th1, a first activity flag c1 of a positive value is generated. Likewise, if the second audio signal #S2 exceeds the far end activity threshold #th2, a second activity flag c2 of a positive value is generated. In step 505, all the first activity flags c1 and second activity flags c2 observed within a time period are individually averaged. If the average exceeds the first/second threshold, first/second error flag e1/e2 of a positive value is individually generated. Otherwise, first/second error flag e1/e2 is set to a zero value. In step 507, the first/second error flag e1/e2 is further averaged over a predetermined time period. If the averaged first/second error flag e1/e2 exceeds a first/second failure threshold, a first/second failure flag f1/f2 of a positive value is generated. Otherwise, the first/second failure flag f1/f2 is set to a zero value. In step 509, the first error flag e1, second error flag e2, first failure flag f1 and second failure flag f2 are output for further analysis.

Figure 6:
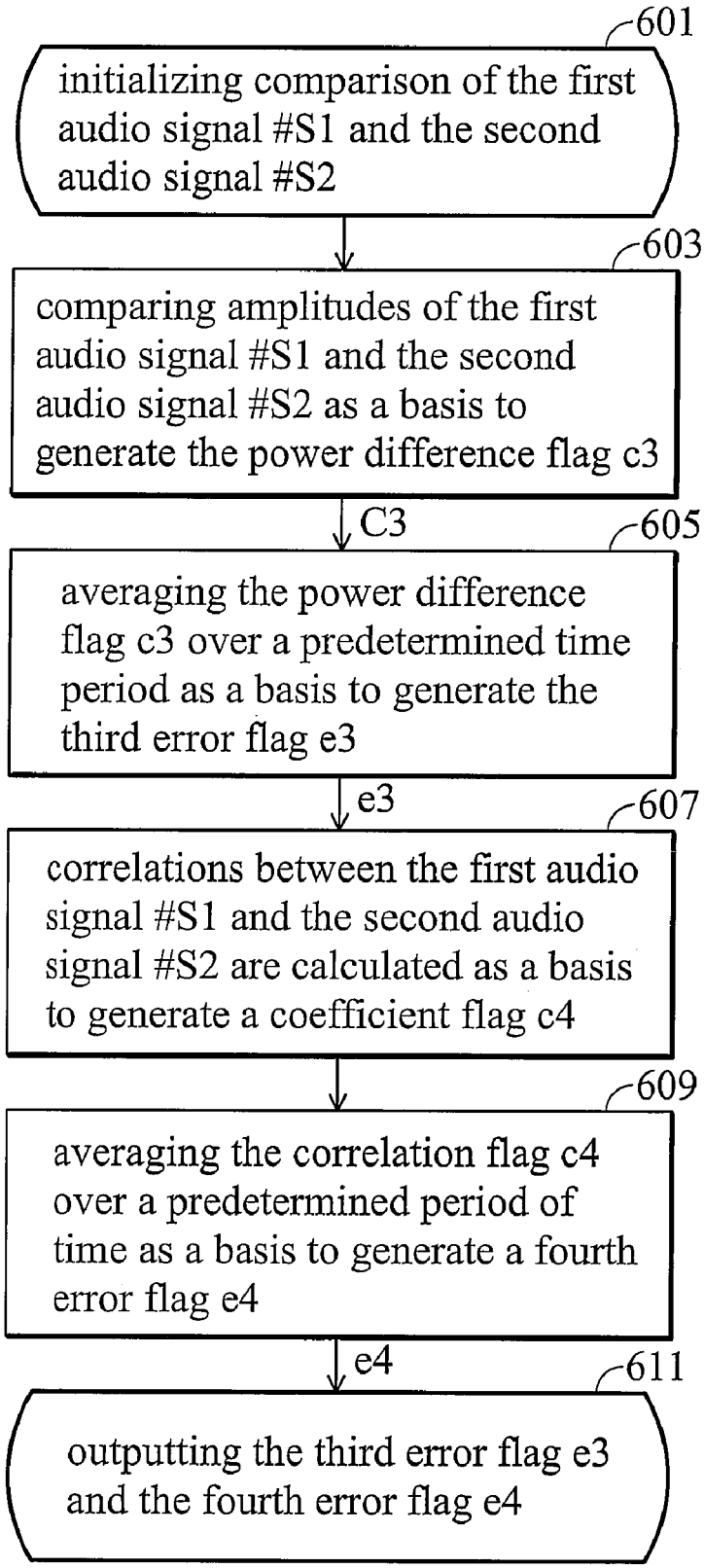
FIG. 6 is a flowchart of comparison of the first audio signal and second audio signal according to the invention.

FIG. 6 is a flowchart of comparison of the first audio signal #S1 and second audio signal #S2 according to the invention. The step of 405 in FIG. 4 is further described in FIG. 6. In step 601, the comparison for the first audio signal #S1 and second audio signal #S2 is initialized. In step 603, amplitudes of the first audio signal #S1 and the second audio signal #S2 are compared in the power difference detector 206. If the first audio signal #S1 exceeds the second audio signal #S2 by $\alpha$ times (#S1>$\alpha$·#S2), or the second audio signal #S2 exceeds the first audio signal #S1 by $\alpha$ times (#S2>$\alpha$·#S1), the power difference detector 206 sets the power difference flag c3 to a zero value (logic 0) to indicate that there may be a potential defect. In step 605, the power difference flag c3 is averaged over a predetermined time period. If the averaged power difference flag c3 exceeds a difference threshold, a third error flag e3 of a positive value is generated. Conversely, if the averaged power difference flag c3 does not exceed the difference threshold, the third error flag e3 is set to a zero value. In step 607, correlation between the first audio signal #S1 and second audio signal #S2 are calculated. The correlation detector 208 may adapt various known algorithms to calculate a correlation coefficient. If the correlation coefficient exceeds a correlation criteria, the correlation detector 208 generates a correlation flag c4 of a positive value, to indicate that the first audio signal #S1 and second audio signal #S2 are correlated. Conversely, if the correlation coefficient does not exceed the correlation criteria, the correlation detector 208 sets the correlation flag c4 to a zero value, to indicate that they are not correlated. In step 609, the correlation flag c4 is averaged over a predetermined period of time. If the averaged correlation flag c4 exceeds a correlation criterion, the statistic unit 220 generates a fourth error flag e4 of a positive value, otherwise of a zero value. With the third error flag e3 and fourth error flag e4 observed, the comparison of first audio signal #S1 and second audio signal #S2 is concluded in step 611.

Figure 7:
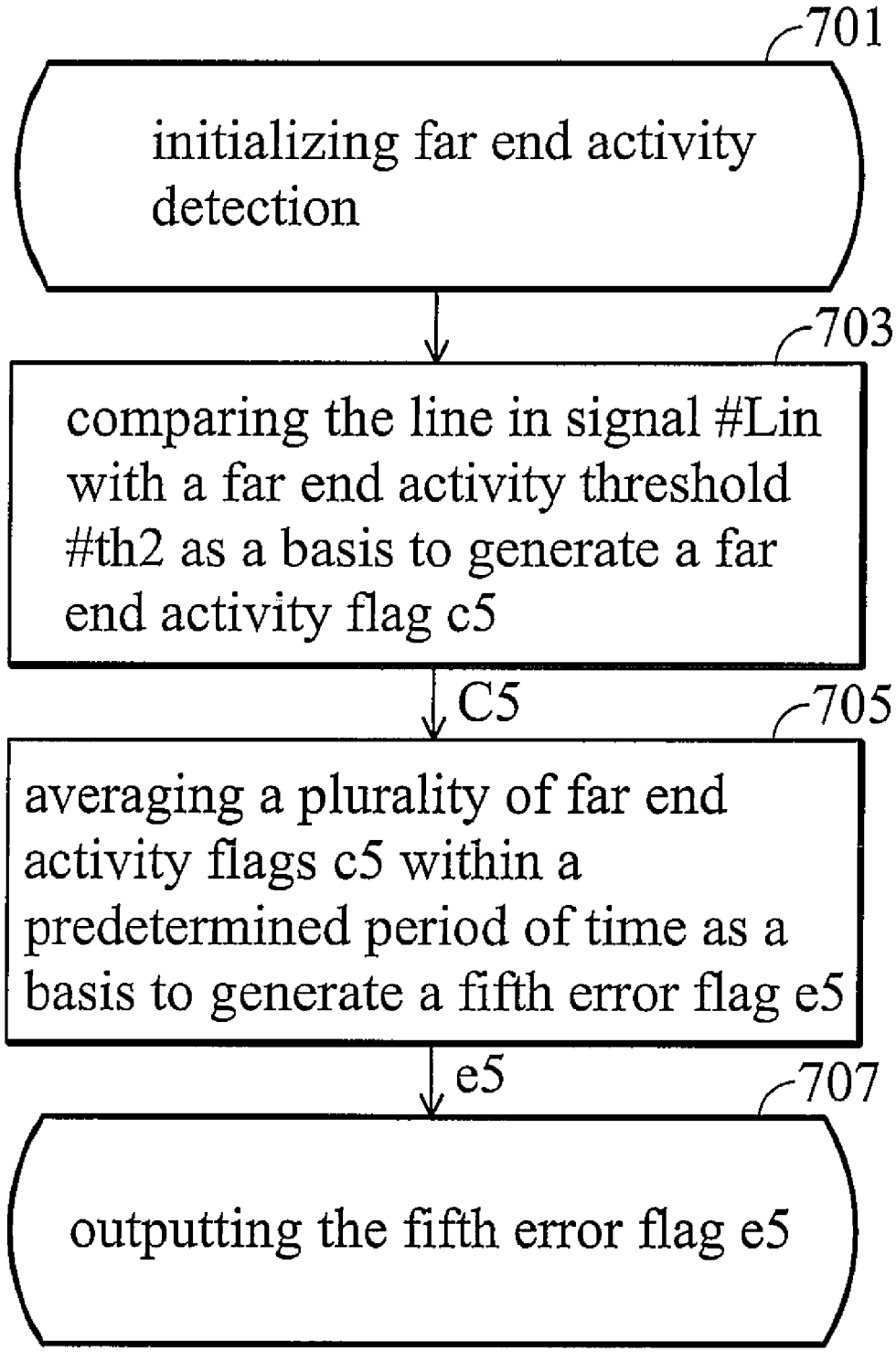
FIG. 7 is a flowchart of a line in signal analysis according to the invention.

FIG. 7 is a flowchart of a line in signal #Lin analysis according to the invention. Voice activity of the line in signal #Lin is detected by the far end activity detector 212. In step 701, the far end activity detector 212 is initialized in a communication mode (#comm=1), and a line in signal #Lin is input. In step 703, the far end activity detector 212 compares the line in signal #Lin with a far end activity threshold #th2 to detect voice activity of the line in signal #Lin. If the line in signal #Lin exceeds the far end activity threshold #th2, the far end activity detector 212 sets the far end activity flag c5 to a positive value, otherwise to a zero value. In step 705, a plurality of far end activity flags c5 within a predetermined period of time are averaged. If the averaged far end activity flag c5 exceeds a far end activity criterion, the statistic unit 220 generates a fifth error flag e5 of a positive value, otherwise of a zero value. With fifth error flag e5 observed, the voice activity detection of a line in signal #Lin is concluded in step 707.

Figure 8:
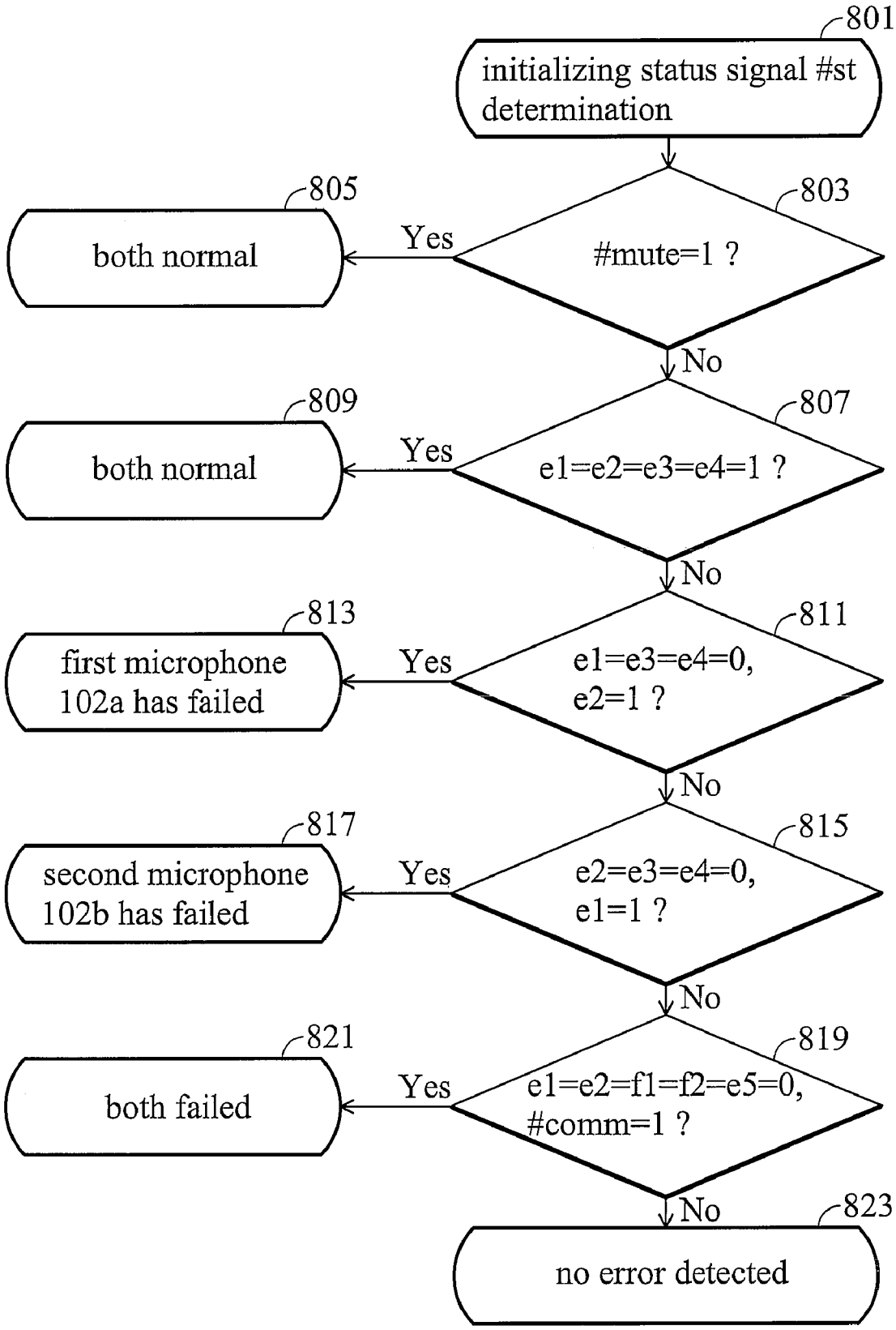
FIG. 8 is a flowchart of a defect detection process according to the invention.

FIG. 8 is a flowchart of a defect detection process according to the invention. The determination of the status signal #St in step 307 is described in detail. In step 801, the decision unit 230 is initialized to determine the status signal #St based on the first error flag e1, second error flag e2, first failure flag f1, second failure flag f2, third error flag e3, fourth error flag e4 and fifth error flag e5 sent from the statistic unit 220. In step 803, it is determined whether the audio device 100 is in a mute mode (#mute=1). Since the first microphone 102*a* and second microphone 102*b* are disabled in the mute mode, there is no need to determine the status signal #St during the mute mode. If the audio device 100 is in the mute mode (#mute=1), step 805 is processed, whereby the status signal #St is set to a first value indicating that all microphones are normal. If the audio device 100 is not in the mute mode (#mute=0), step 807 is processed. In step 807, it is determined whether the first error flag e1, second error flag e2, third error flag e3 and fourth error flag e4 are all positive (e1=e2=e3=e4=1). If the first error flag e1, second error flag e2, third error flag e3 and fourth error flag e4 are all positive (e1=e2=e3=e4=1), it means voice activity on the first microphone 102*a* and second microphone 102*b* are positive, the differences between the first audio signal #S1 and second audio signal #S2 are subsequently matched, and there is high correlation between the first audio signal #S1 and second audio signal #S2. Inherently, step 809 is processed, in which the status signal #St is set to the first value, to indicate that both the first microphone 102*a* and second microphone 102*b* are good.

If step 807 results in a negative result, step 811 is processed. In step 811, it is determined whether the first error flag e1, third error flag e3 and fourth error flag e4 are zero while the second error flag e2 is positive (e1=e3=e4=0, e2=1). If so, it means that the first microphone 102*a* is defective while the second microphone 102*b* is normal, and the status signal #St is set to a second value in step 813 to indicate the situation.

If step 811 results in a negative result, step 815 is processed. In step 815, it is determined whether the second error flag e2, third error flag e3, and fourth error flag e4 are zero while the first error flag e1 is positive (e2=e3=e4=0, e1=1). If so it means that the second microphone 102*b* is defective while the first microphone 102*a* is normal, thus in step 817, the status signal #St is set to a third value, to indicate the situation.

If step 815 results in a negative result, step 819 is processed. In step 819, it is determined whether the first error flag e1, second error flag e2, first failure flag f1, and second failure flag f2 are all zero while the fifth error flag e5 is zero (e1=e2=f1=f2=e5=0, #comm=1). If so, it can be determined that both the first microphone 102*a* and second microphone 102*b* are defective, and consequently, step 821 is processed, in which the status signal #St is set to a fourth value.

If step 819 results in a negative result, step 823 is processed. Since there no defect is detected, the status signal #St is set to the first value, and the defect detection is concluded in step 823.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An audio device, comprising:

a microphone array for receiving ambient audio signals, comprising at least a first microphone and a second microphone, wherein the first and second microphones respectively generate a first audio signal and a second audio signal from the ambient signals;

an error detector, coupled to the first and second microphones, detecting functions of the first and second microphones based on the first and second audio signals to generate a status signal;

a digital signal processor (DSP), coupled to the first microphone, second microphone and the error detector, processing the first and second audio signals based on the status signal, wherein, if the status signal indicates that both the first microphone and the second microphone are normal, the DSP switches to a normal mode in which both the first and second audio signals are processed, and if the status signal indicates that only the first microphone or the second microphone is defective, the DSP switches to a single microphone mode in which only audio signals from the remaining normal microphone is processed, and if the status signal indicates that both the first and second microphones are defective, the DSP generates an error indication signal and stops processing the first and second audio signals;

wherein the error detector comprises:

a first activity detector, comparing the first audio signal with a local activity threshold to generate a first activity flag for indicating voice activity of the first audio signal;

a second activity detector, comparing the second audio signal with the local activity threshold to generate a second activity flag for indicating voice activity of the second audio signal;

a power difference detector, comparing the first and second audio signals to generate a power difference flag for indicating whether the differences between the first and second audio signals exceed a predetermined ratio; and a correlation detector, determining correlation of the first and second audio signals to generate a correlation flag for indicating whether the first and second audio signals are correlated.

2. The audio device as claimed in claim 1, wherein the error detector further comprises:

a statistic unit, coupled to the first activity detector, second activity detector, power difference detector and correlation detector to gather statistics on the first activity flag, second activity flag, power difference flag and correlation flag over a predetermined time period to generate corresponding statistical results; and a decision unit, coupled to the statistic unit to generate the status signal based on the statistical results.

3. The audio device as claimed in claim 2, wherein:

if the first audio signal exceeds the local activity threshold, the first activity detector sets the first activity flag to a positive value, otherwise to a zero value;

the statistic unit averages a plurality of first activity flags observed within a time period, and if an average of the first activity flags exceeds a first threshold, the statistic unit generates a first error flag of a positive value, otherwise of a zero value; and the statistic unit averages a plurality of first error flags observed within the predetermined time period, and if an average of the first error flags exceeds a first failure threshold, the statistic unit generates a first failure flag of a positive value, otherwise of a zero value.

4. The audio device as claimed in claim 3, wherein:

if the second audio signal exceeds the a end activity threshold, the second activity detector sets the second activity flag to a positive value, otherwise to a zero value;

the statistic unit averages a plurality of second activity flags observed within a time period, and if an average of the second activity flags exceeds a second threshold, the statistic unit generates a second error flag of a positive value, otherwise of a zero value;

the statistic unit averages a plurality of second error flags observed within the predetermined time period, and if an average of the second error flags exceeds a second failure threshold, the statistic unit generates a second failure flag of a positive value, otherwise of a zero value.

5. The audio device as claimed in claim 4, wherein:

if the first audio signal exceeds the second audio signal multiplied by the predetermined ratio, or the second audio signal exceeds the first audio signal multiplied by the determined ratio, the power difference detector sets the power difference flag to a zero value, otherwise a positive value; and the statistic unit averages a plurality of power difference flags observed within the predetermined time period, and if an average of the power difference flags exceeds a difference threshold, the statistic unit generates a third error flag of a positive value, otherwise of a zero value.

6. The audio device as claimed in claim 5, wherein:

if correlation between the first and second audio signals exceeds a correlation threshold, the correlation detector sets the correlation flag to a positive value, otherwise to a zero value; and the statistic unit averages a plurality of correlation flags observed within the predetermined time period, and if an average of the correlation flags exceeds a correlation criterion, the statistic unit generates a fourth error flag of a positive value, otherwise of a zero value.

7. The audio device as claimed in claim 6, wherein the error detector is enabled only when the first and second microphones are not muted, and is disabled when the first and second microphones are muted.

8. The audio device as claimed in claim 7, wherein:

if the first error flag, second error flag, third error flag and fourth error flag are positive, the decision unit sets the status signal to a first value, to indicate that both the first and second microphones are good;

if the first error flag, third error flag and fourth error flag are zero while the second error flag is positive, the decision unit sets the status signal to a second value, to indicate that the first microphone is defective; and if the second error flag, third error flag and fourth error flag are zero while the first error flag is positive, the decision unit sets the status signal to a third value, to indicate that the second microphone is defective.

9. The audio device as claimed in claim 8, wherein:

the audio device receives a line in signal while in a communication mode, and the error detector further comprises a far end activity detector, comparing the line in signal with a far end activity threshold to generate a far end activity flag for indicating voice activity of the line in signal.

10. The audio device as claimed in claim 9, wherein:

if the line in signal exceeds the far end activity threshold, the far end activity detector sets the far end activity flag to a positive value, otherwise to a zero value; and the statistic unit averages a plurality of far end activity flags observed within the predetermined time period, and if an average of the far end activity flag exceeds a far end activity criterion, the statistic unit generates a fifth error flag of a positive value, otherwise of a zero value.

11. The audio device as claimed in claim 10, wherein if the audio device is in the communication mode, and the first error flag, second error flag, first failure flag, second failure flag and fifth error flag are all zero, the decision unit sets the status signal to a fourth value, to indicate that both the first and second microphones are defective.

12. The audio device as claimed in claim 1, further comprising:

a first ADC, coupled to the first microphone, digitizing the first audio signal before the error detector and the DSP processes the first audio signal; and a second ADC, coupled to the second microphone, digitizing the second audio signal before the error detector and the DSP processes the second audio signal.

13. The audio device as claimed in claim 1, wherein the microphone array can be easily extended to a device with more than two microphones.

* * * * *